US007618026B2

(12) United States Patent
Armstrong

(10) Patent No.: US 7,618,026 B2
(45) Date of Patent: Nov. 17, 2009

(54) COOLING TOWER FILL SUPPORT GRID ASSEMBLY AND METHOD

(76) Inventor: Charles M. Armstrong, 3776 Park Pl., Addison, TX (US) 75001

( * ) Notice: Subject to any disclaimer, the term of this patent is extended or adjusted under 35 U.S.C. 154(b) by 507 days.

(21) Appl. No.: 11/512,857

(22) Filed: Aug. 30, 2006

(65) Prior Publication Data

US 2007/0045879 A1 Mar. 1, 2007

Related U.S. Application Data

(60) Provisional application No. 60/713,085, filed on Sep. 1, 2005.

(51) Int. Cl.
*B01F 3/04* (2006.01)

(52) U.S. Cl. ..... 261/111; 52/654.1

(58) Field of Classification Search ..... 261/108, 261/111; 52/633, 654.1; 428/131, 134
See application file for complete search history.

(56) References Cited

U.S. PATENT DOCUMENTS

| | | | | | |
|---|---|---|---|---|---|
| 3,468,521 | A | * | 9/1969 | Furlong et al. | 261/111 |
| 3,749,381 | A | * | 7/1973 | Furlong et al. | 261/111 |
| 3,791,634 | A | * | 2/1974 | Phelps | 261/111 |
| 4,133,851 | A | | 1/1979 | Ovard | 261/111 |
| 4,178,333 | A | * | 12/1979 | Shepherd | 261/111 |
| 4,269,795 | A | | 5/1981 | Bosman | 261/111 |
| 4,439,378 | A | | 3/1984 | Ovard | 261/111 |
| 4,557,878 | A | | 12/1985 | Fulkerson | 261/111 |
| 4,576,764 | A | | 3/1986 | Shepherd et al. | 261/111 |
| 4,578,227 | A | * | 3/1986 | Ovard | 261/111 |
| 4,774,034 | A | | 9/1988 | Fritz | 261/111 |
| 4,803,018 | A | | 2/1989 | LeFeure et al. | 261/111 |
| 4,868,956 | A | | 9/1989 | Shepherd | 24/336 |
| 5,104,588 | A | * | 4/1992 | Kinney, Jr. | 261/111 |
| 5,185,105 | A | * | 2/1993 | Peterson | 261/111 |
| 5,454,987 | A | * | 10/1995 | Cornwell, Jr. | 261/111 |
| 6,083,441 | A | * | 7/2000 | Ptaschek et al. | 264/159 |
| 6,708,960 | B2 | | 3/2004 | Olson et al. | 261/111 |
| 6,877,727 | B2 | | 4/2005 | Olson et al. | 261/111 |
| D547,428 | S | * | 7/2007 | Kinney, Jr. et al. | D23/351 |

* cited by examiner

*Primary Examiner*—Scott Bushey
(74) *Attorney, Agent, or Firm*—John M. Harrison

(57) ABSTRACT

A cooling tower fill support grid assembly and method of use which includes multiple cooling tower assembly fill hangers, each having a grid pattern that defines multiple grid openings of selected size. In one embodiment an anchor rivet pin extends from the horizontal grid members upwardly and disproportionally spaced-apart from the vertical grid members, into each grid opening. The anchor rivet pins are located off-center on the horizontal grid members between respective vertical grid members for engaging elliptical splash fills that are inserted in the aligned grid openings of adjacent assembly fill hangers in a first configuration. Once so inserted, the elliptical splash fills are rotated ninety-degrees into contact and engagement with the anchor rivet pins in a second, installed configuration. In another embodiment resilient, perforated plate splash fills are seated in the fill hangers and are removably retained between the respective vertical grid members by notches or nibs provided in or on the vertical grid members. The top edge of each assembly fill hanger typically has a notched flange for stacking and seating on the cooling tower frame and holes are provided in the flange for receiving nails.

13 Claims, 4 Drawing Sheets

COOLING TOWER FILL SUPPORT GRID ASSEMBLY AND METHOD

CROSS-REFERENCE TO RELATED APPLICATIONS

This application claims the benefit of and incorporates by reference U.S. Provisional Application Ser. No. 60/713,085, Filed Sep. 1, 2005.

FIELD OF THE INVENTION

This invention relates to contacting apparatus for mass and heat transfer operations and more particularly, to support grids or fill hangers for receiving, engaging and supporting elliptical fill splash bars and/or resilient, perforated plates, typically in cooling tower applications. Air-liquid contact in cooling towers is optimized by providing a high volume void to effect a low resistance to fluid flow, along with a large surface area per unit of volume and low density to facilitate optimum contact surface with minimum weight. The fill support grids or hangers of this invention are designed to achieve this end and are disposed in a stacked assembly designed for quick and easy attachment to a two by four wooden framework in the cooling tower, without the necessity of using retainer clips or fastener tabs to secure the fill structure in the respective fill hanger grid openings or the fill hangers to the cooling tower framework.

SUMMARY OF THE INVENTION

The cooling tower fill support grid assembly of this invention is designed to accept and mount elliptical splash bars, grids and/or resilient, perforated plate fill with high economy and efficiency, since no external clips or fasteners are required to secure the elliptical splash bars or grids or the perforated plate fill in the respective aligned hanger grid openings of the respective support grid assembly fill hanger elements. The support grid assembly includes an assembly or collection of spaced-apart, stacked, typically parallel sets of fill hangers, each having a hanger grid typically constructed of vertical and horizontal grid members that are spaced-apart to define hanger grid openings of selected size. While the grid members can be skewed instead of parallel, a parallel grid member orientation is preferred. In one embodiment, an anchor rivet pin extends upwardly from each of the horizontal grid members into a corresponding hanger grid opening in off-center relationship with respect to the adjacent vertical grid members. This disproportionate positioning or spacing of the anchor rivet pins leaves a large space between each anchor rivet pin and one of the corresponding vertical grid members for insertion of an elliptical splash fill having a splash fill grid defining splash fill grid openings. After insertion with the major or long axis vertically oriented, the elliptical splash fills are typically rotated ninety-degrees in the aligned hanger grid openings and caused to engage the anchor rivet pins, each at an aligned elliptical splash fill grid opening, to secure the elliptical splash fills in place in the cooling tower fill support grid assembly. In another embodiment, resilient, perforated "gull wing" plates are inserted in the respective hanger grid openings and are removably secured in place between the respective vertical grid members 9 by nibs or slots provided on or in the grid members. In a preferred embodiment of the invention the top edge of each fill hanger is shaped to define an L-shaped flange provided with spaced-apart openings to receive fasteners such as nails for securing the fill hangers to a 2×4 frame without the necessity of using mounting clips or retainers. Spaced-apart notches may also be provided on the fill hanger flange for securing the fill hangers to each other in stacked, spaced-apart relationship.

BRIEF DESCRIPTION OF THE DRAWINGS

The invention will be better understood by reference to the accompanying drawings, wherein.

DESCRIPTION OF THE PREFERRED EMBODIMENTS

Figure 1:
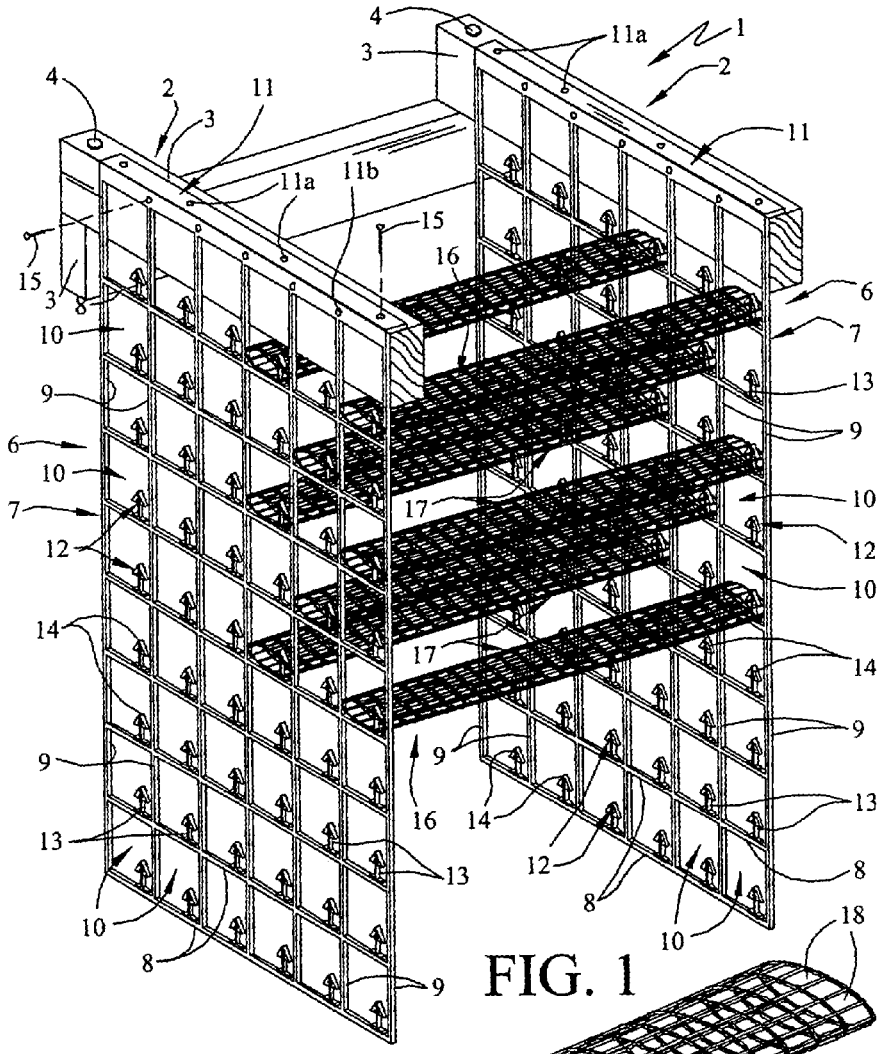
FIG. 1 is a perspective view of a first embodiment of the cooling tower fill support grid assembly of this invention.
Figure 2:
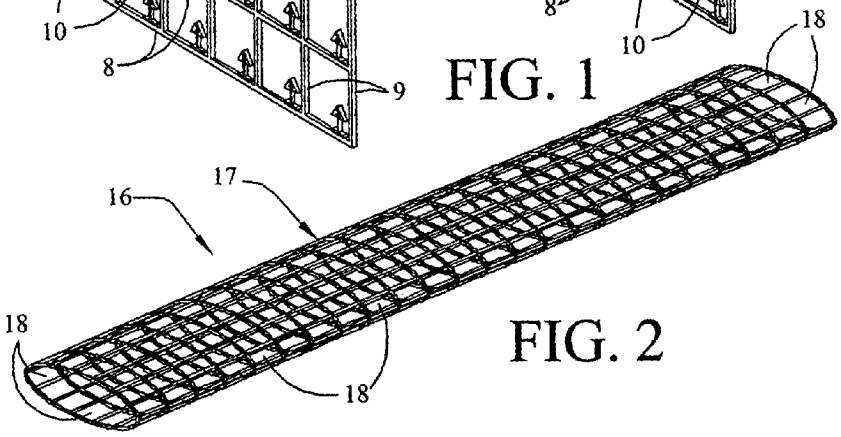
FIG. 2 is a perspective view of a typical elliptical fill element inserted in the fill support grid assembly illustrated in FIG. 1.
Figure 4:
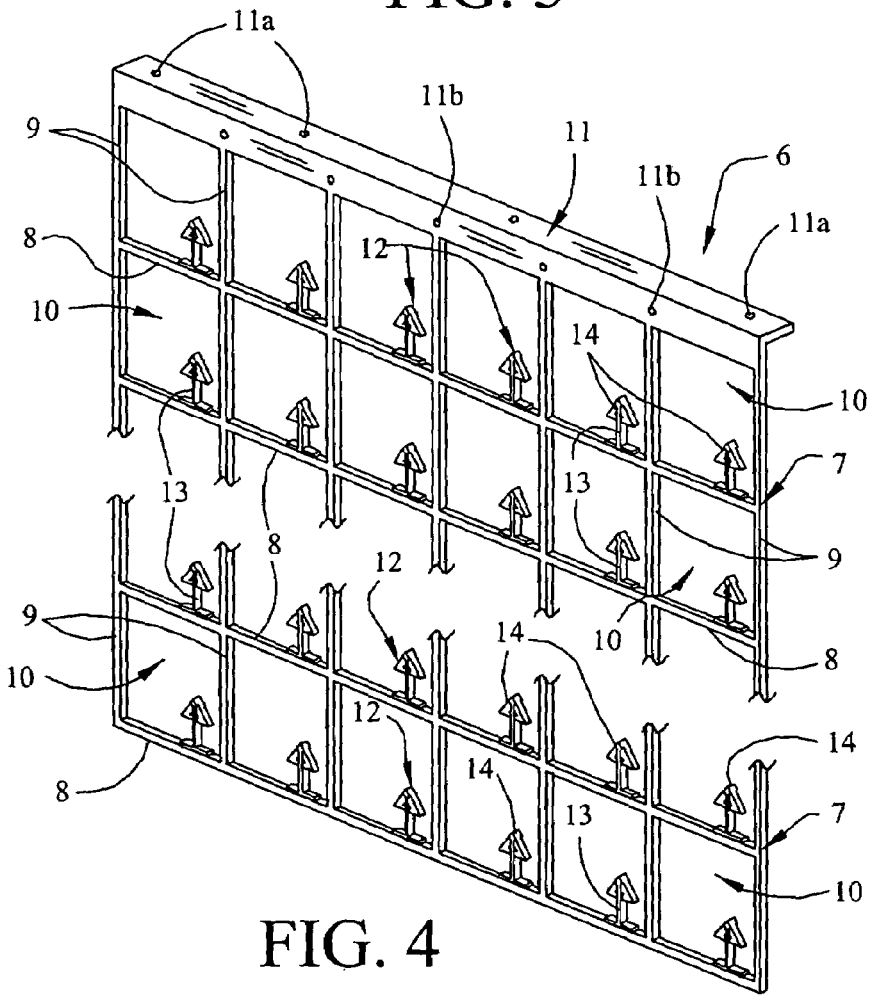
FIG. 4 is a perspective view, partially in section, of a typical fill hanger illustrated in FIG. 1.

Referring initially to FIGS. 1 and 4 of the drawings, a typical fill support grid assembly of this invention is illustrated by reference numeral 1. The fill support grid assembly 1 includes a pair or set of fill hangers 6, mounted in spaced-apart, generally parallel relationship with respect to each other on an assembly frame 2 (FIG. 1). The assembly frame 2 is typically constructed of wooden frame members 3, such as 2×4 boards that are secured to each other by frame member fasteners 4. The frame member fasteners 4 are typically nails or screws and the fill hangers 6 are attached to the frame members 3 at the respective grid flanges 11, shaped in the top edges thereof. Accordingly, in a preferred embodiment of the invention the fill hangers 6 are molded in a selected cross-sectional configuration of a suitable plastic material such as polyethylene and polypropylene and most preferably, nylon, or they may be constructed of steel having a plastic coating. The grid flanges 6 are typically L-shaped, as in the configuration of angle iron and typically have spaced-apart top openings 11*a* provided in the horizontal flange element and spaced-apart side openings 11*b* in the vertical element of the grid flange 6. The top openings 11*a* and side openings 11*b* may be reinforced by thickened rings and are located and sized to accommodate nails or screws and quickly and efficiently mount the fill hangers 6 on the respective frame members 3 of the assembly frame 2, as hereinafter further described. As further illustrated in FIG. 1, the fill hangers 6 can be aligned with the respective frame members 3 wherein the top or horizontal flange element of the grid flange 11 is positioned on top of the frame members 3 and the side or vertical flange element is positioned against the side of the frame members 3, respectively. Fasteners such as nails 15 (FIG. 1) can then be quickly and easily extended through the respective top openings 11*a* and/or the side openings 11*b* and driven into the wooden frame members 3, without the need for clips, retainers or brackets which are commonly used to install fill hangers on an assembly frame in conventional cooling tower installations.

Figure 3:
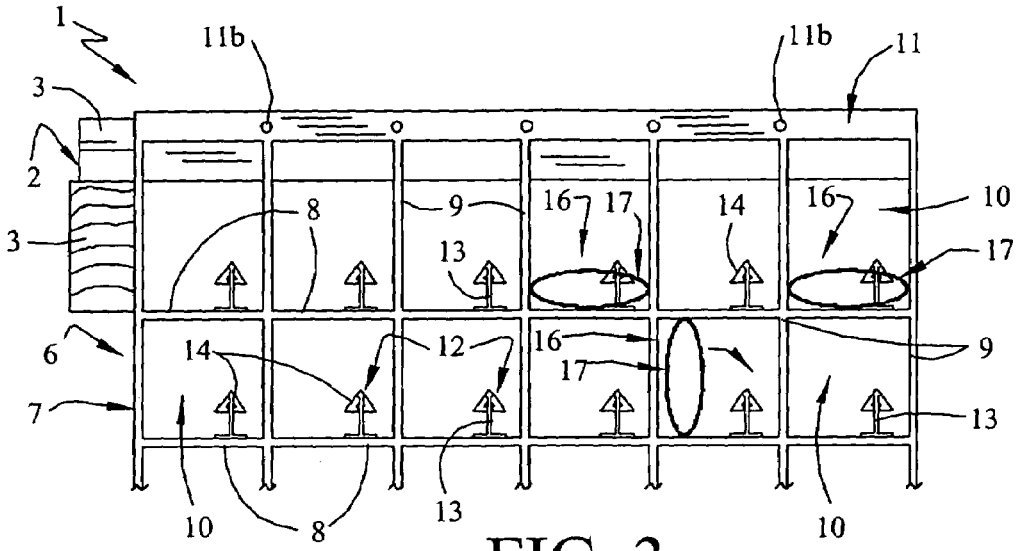
FIG. 3 is a front elevation, partially in section, of the top portion of a typical fill hanger with the elliptical splash fills in place, more particularly illustrating a preferred placement and manipulation of the elliptical splash fills in the hanger grid of the fill hanger.

Referring next to FIGS. 1-4 of the drawings, the fill hangers 6 are each further characterized by a hanger grid 7, defined in a preferred embodiment by horizontal grid members 8 and vertical grid members 9 of selected cross-sectional configuration. The horizontal grid members 8 and vertical grid members 9 further define hanger grid openings 10 of a selected size or sizes determined by the spacing of the horizontal grid members 8 and the vertical grid members 9. In this embodiment of the invention each of the horizontal grid members 8 has spaced-apart anchor rivet pins 12 extending upwardly therefrom into a corresponding hanger grid opening 10 in disproportionate or off-center relationship with respect to the two adjacent vertical grid members 9, as illustrated in FIGS. 1, 3 and 4. Each of the anchor rivet pins 12 typically includes a pin base 13, extending from attachment to or shaped integrally with a corresponding horizontal grid member 8, and a wedge-shaped, flared tip 14 terminating the pin base 13. The flared tips 14 of the anchor rivet pins 12 are each sized to fit through the fill grid openings 18 in a corresponding elliptical fill grid 17 of a length of splash fill 16 (FIG. 2), which has a cross-section shaped generally in the configuration of an ellipse. A typical splash fill 16 for application in the fill support grid assembly of this embodiment of the invention is the Opti-Bar (trademark) marketed by Tower Components Incorporated. As in the case of the fill hanger 6, the fill grids 17 of the splash fills 16 are typically constructed of a plastic material such as high density polyethylene, nylon or the like and the curved fill grids 17 are each characterized by fill grid openings 18 that are slightly smaller than the flared tip 14 of each anchor rivet pin 12 carried by the respective horizontal grid members 8 in the hanger grid 7 of the fill hangers 6.

Referring now to FIGS. 1 and 3 of the drawings, according to the method of this embodiment of the invention each fill grid 17 is inserted in a parallel assembly or set of fill hangers 6 (FIG. 1), typically through the wider of the two spaces in the registering hanger grid openings 10 on corresponding horizontal grid members 8, between the respective anchor rivet pins 12 and the adjacent vertical members 9. The elliptical fill grids 17 are so inserted with the long or major axis of the ellipse in vertical orientation (FIG. 3) to clear the respective anchor rivet pins 12. When each elliptical fill grid 17 is fully inserted in the corresponding aligned hanger grid openings 10 in the respective hanger grids 7 of the parallel fill hangers 6, the fill grids 17 are rotated ninety degrees in the direction of the arrow in FIG. 3, such that each fill grid 17 is oriented with the long or major axis of the ellipse in the horizontal position and the ends of the fill grids 17 typically snugly engaging the adjacent, parallel vertical grid members 9. In the course of this 90-degree rotation of the fill grids 17, the flared tip 14 of each of the anchor rivet pins 12 projects through an aligned one of the fill grid openings 18 in the corresponding fill grid 17 in a friction fit, such that the elliptical fill grids 17 are removably anchored in the respective hanger grid openings 10 of the fill hangers 6. By "friction fit" is meant an initially spreading by flexure of the fill grid members in the fill grids 17 defining the fill grid openings 18, to allow passage of the flared tips 14 of the respective anchor rivet pins 12, and then narrowing of the respective fill grid openings 18 by operation of the memory in the fill grid members, to trap the flared tip 14 inside the corresponding fill grid 17 and secure the fill grids 17 in position in the respective fill hangers 6 (FIGS. 1 and 3). Alternatively, or in combination with this flexure of the fill grid members in each fill grid 17, the flared tips 14 may also be designed with sufficient resiliency to initially deform and then spring back to effect the desired security in mounting the fill grids 17 in the fill hangers 6.

Accordingly, it will be appreciated by those skilled in the art that the flared tip 14 element of the anchor rivet pins 12 can be of any desired shape, size and resiliency which is compatible with extension or projection through the aligned fill grid openings 18 of the elliptical fill grids 17 of the splash fills 16. Furthermore, under circumstances where the fill hangers 6 are injection-molded or otherwise fabricated from a material such as nylon (a preferred material) and plastics such as polyethylene and polypropylene, in non-exclusive particular, the pin base 13 and flared tip 14 elements of the anchor rivet pins 12 can be likewise molded with the hanger grids 7 of the respective fill hangers 6, according to the knowledge of those skilled in the art.

Figure 5:
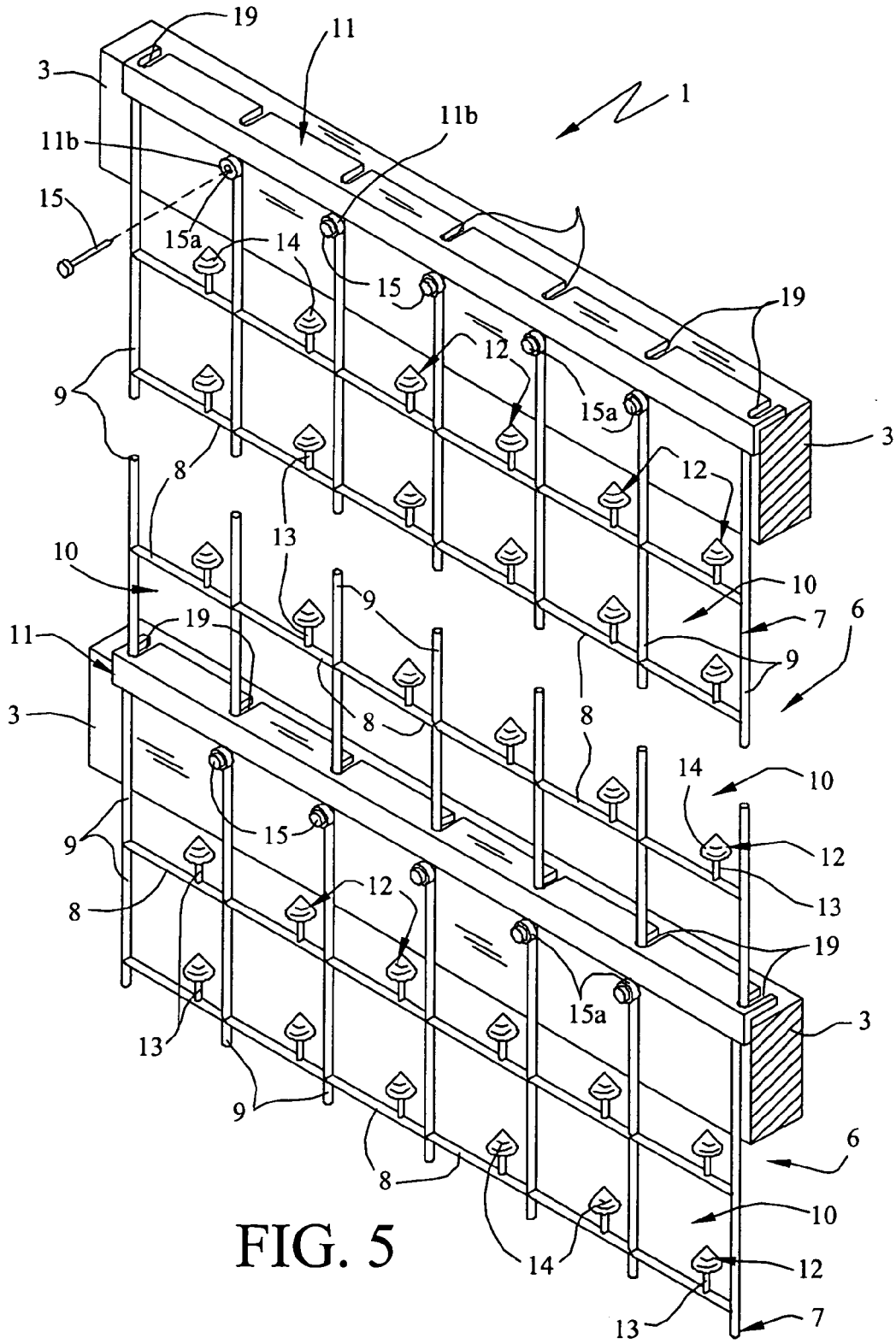
FIG. 5 is a perspective view, partially in section, of a typical stacked mounting of adjacent fill hangers in the fill support grid assembly and an alternative configuration for the anchor rivet pins.

Referring now to FIG. 5 of the drawings, in another embodiment of the invention a segment of the fill support grid assembly 1 is illustrated by a pair of fill hangers 6 having hanger grids 7 which are secured to each other in stacked relationship, wherein the top fill hanger 6 is attached to the bottom fill hanger 6 at a grid flange 11. This grid flange 11 on the bottom fill hanger 6 includes multiple, spaced-apart flange notches 19 which receive the bottom ends of the corresponding vertical grid members 9 of the top fill hanger 6, as illustrated in FIG. 5. Accordingly, the respective hanger grids 7 of the top and bottom fill hangers 6 are typically assembled as illustrated in FIG. 5, wherein nails 15 can be driven into the corresponding side openings 11*b* and secured to the frame members 3 as indicated in the drawings, to assemble the respective fill hangers 6. Under circumstances where multiple fill hangers 6 are stacked as illustrated in FIG. 5 and no frame members 3 are needed at the interfaces, the bottom ends of the top hanger grid 7 can be secured to the grid flange 11 of the bottom hanger grid 7 using wire or plastic ties, as desired.

In another preferred embodiment of the invention and referring again to FIG. 5, the anchor rivet pins 12 are configured somewhat differently from those illustrated in the first embodiment of the invention illustrated in FIGS. 1-4. In this latter embodiment each of the anchor rivet pins 12 are characterized by an upward-standing pin base 13 attached to a corresponding horizontal grid member 8 as indicated in FIGS. 1-4 of the drawings. However, the flared tip 14 extending from each of the pin base bases 13 is cone-shaped to engage the fill grid openings 18 in the respective fill grids 17 and secure the fill grids 17 in the corresponding hanger grid openings 10, as illustrated in FIGS. 1-4 and heretofore described.

Figure 6:
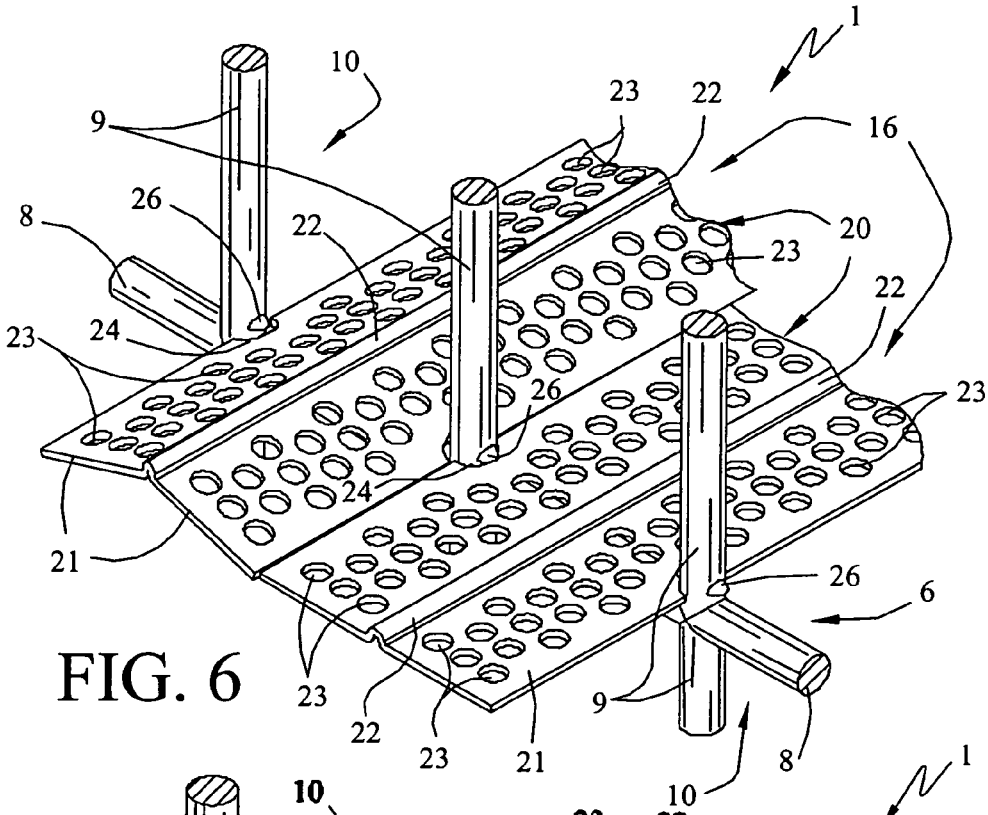
FIG. 6 is a perspective view of a second embodiment of the fill support and assembly of this invention using resilient, perforated plate fills in a first plate mount configuration.
Figure 7:
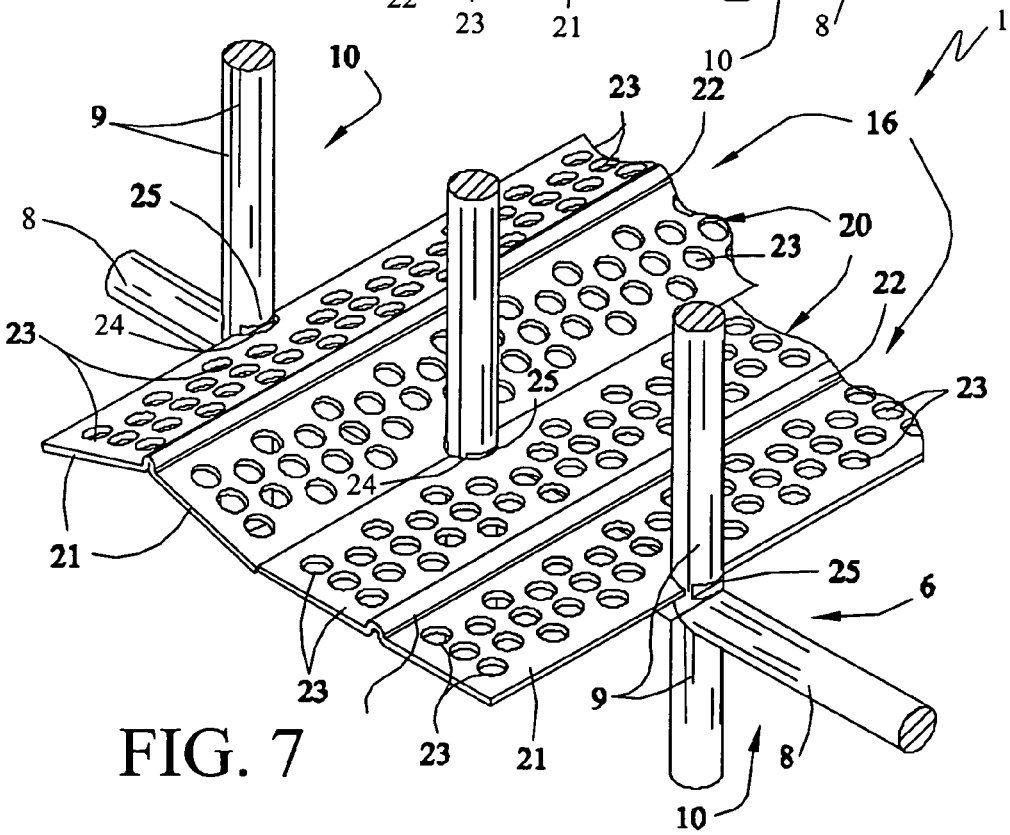
FIG. 7 is a perspective view of a second embodiment of the fill support and assembly using resilient, perforated plate fills in a second plate mount configuration.

Referring to FIGS. 6 and 7 of the drawings, in yet another preferred embodiment of the invention, each of the vertical grid members 9 is fitted with oppositely-disposed grid nibs 26 (FIG. 6) and grid notches 25 (FIG. 7) above the connecting horizontal grid members 8, for receiving the plate slots 24 provided in corresponding longitudinal edges of the plate 21 of a "gull wing" fill grid 20, having a central longitudinal plate ridge 22 and fitted with plate openings 23. The gull wing fill grid 20 is detailed in U.S. Pat. No. 4,576,764 and is installed as a splash fill 16 in the respective hanger grids 7 of the fill hangers 6 of this invention. The gull wing fill grid 20 is typically fitted with the longitudinally spaced-apart plate slots 24 which may be quickly and easily seated in the respective hanger grid openings 10 of the hanger grids 7, between the corresponding vertical grid members 9, in the following manner. Each of the plates 21 of the respective gull wing fill grids 20 is typically grasped at one end, with the fingers and thumb positioned across the expanse or width of the plate 21 and the plate 21 is then bent or deformed longitudinally along the plate ridge 22, into the position illustrated in the left-hand portion of FIGS. 6 and 7. Each plate 21 is then inserted in this bent configuration, into registering hanger grid openings 10 in the parallel hanger grids 7 of the fill hangers 6 to align the respective plate slots 24 with the grid nibs 26 (FIG. 6) and the grid notches 25 (FIG. 7), provided in the corresponding, oppositely-disposed vertical grid members 9 in the fill hangers 6. Each plate 21 is then released, allowing the plate 21 to assume its original position by memory, as illustrated in the right hand portion of FIGS. 6 and 7 and fully engage the respective plate slots 24 of the plates 21 with the corresponding grid nibs 26 (FIG. 6) and grid notches 25 (FIG. 7). In this manner, the respective plates 21 of the gull wing fill grid 20 are removably, yet securely installed in the hanger grids 7 of the fill hangers 6 in longitudinal, edge-to-edge configuration, as illustrated in FIGS. 6 and 7.

It will be appreciated that the fill support grid assembly 1 in all embodiments of this invention can be installed on new cooling towers or retrofitted to existing cooling towers characterized by both counter-flow and cross-flow application, as well as in other mass and heat transfer equipment applications requiring liquid-gas, extended surface, interphase contact conditions. Accordingly, the fill support grid assembly 1 can be used in such applications as trickle filters, absorption towers, air washer cells, stripping units and heat recovery economizer units, in non-exclusive particular, in addition to the cooling tower application set forth herein. Moreover, both of the hanger grid 7 designs which accommodate the elliptical fill grids 17 and gull wing fill grids 20 can be used in a single installation, if so desired.

Referring again to FIGS. 1 and 5 of the drawings, when the hanger grids 7 of the respective fill hangers 6 are to be installed on the frame members 3 of the assembly frame 2, each hanger grid 7 is typically grasped by one hand and the grid flange 11 seated on the appropriate frame member 3, with the horizontal element of the grid flange 11 extending over the top of the frame member 3 and the vertical element thereof fitted tightly against the side of the frame member 3. A hammer is then typically grasped by the other hand and the nails 15, typically magnetically seated on the hammer, are driven sequentially through one of the top openings 11*a* or the side openings 11*b* to fasten the fill hangers 6 to the frame member 3 of the assembly frame 2. This design facilitates mounting the respective fill hangers 6 on the corresponding frame members 3 of the assembly frame 2 by one person, thus cutting labor costs as well as saving time. Additional nails 15 can then be driven through the remaining top openings 11*a* (FIG. 1) and side openings 11*b* into the frame members 3 to complete the fill hanger installation. Under circumstances where the stacked fill hanger design illustrated in FIG. 5 is utilized, the respective fill hangers 6 can be suspended from the frame members 3 as illustrated and then mounted in a stacked arrangement by securing the respective slotted grid flanges of the hanger grid; on the frame members 3 at selected increments. At those slotted grid flange 11 interfaces where no frame members 3 are installed, the two stacked fill hangers 6 can be connected by metal or plastic ties.

A primary advantage of using the preferred nylon hanger grids 7 in the fill support grid assembly 1 of this invention is the facility for shipping these components without fear of nicking or bending damage, as is the case with respect to stainless steel and polyvinyl chloride (PVC)-coated wire fill hangers. Moreover, the hanger grids 7 are so designed that the gull wing fill grids 20, as well as the elliptically-shaped splash fills 16 used in the fill support grid assembly 1 of this invention are easily inserted in the respective hanger grid openings 10 highly efficient in eliminating the undesirable streaming and channeling of water which is so prevalent in other splash fill designs.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A cooling tower fill support and grid assembly comprising at least one pair of fill hangers, each of said fill hangers characterized by a first plurality of spaced-apart grid members and a second plurality of spaced-apart grid members intersecting said first plurality of spaced-apart grid members to define a plurality of grid openings and an anchor rivet pin characterized by a pin base provided on selected ones of said first plurality of spaced-apart grid members and a flared tip terminating said pin base for extending into said grid openings for engaging the fill, said anchor rivet pin disproportionally spaced-apart from said second plurality of spaced-apart grid members, respectively.

2. The cooling tower fill support and grid assembly of claim 1 wherein said first plurality of spaced-apart grid members are disposed in substantially parallel relationship with respect to each other.

3. The cooling tower fill support and grid assembly of claim 1 wherein said second plurality of spaced-apart grid members are disposed in substantially parallel relationship with respect to each other.

4. The cooling tower fill support and grid assembly of claim 1 wherein:

(a) said first plurality of spaced-apart grid members are disposed in substantially parallel relationship with respect to each other; and (b) said second plurality of spaced-apart grid members are disposed in substantially parallel relationship with respect to each other.

5. The cooling tower fill support and grid assembly of claim 1 comprising a generally L-shaped flange provided on at least a portion of each of said fill hangers and at least one opening provided in said flange for receiving a fastener and securing said flange to the cooling tower.

6. The cooling tower fill support and grid assembly of claim 5 wherein:

(a) said first plurality of spaced-apart grid members are disposed in substantially parallel relationship with respect to each other; and (b) said second plurality of spaced-apart grid members are disposed in substantially parallel relationship with respect to each other.

7. The cooling tower fill support and grid assembly of claim 6 comprising a plurality of notches provided in said flange for receiving the bottom ones of said second plurality of spaced-apart grid members in a pair of said fill hangers, wherein said fill hangers are engaged in stacked relationship with respect to each other.

8. A cooling tower fill support and grid assembly for receiving and mounting an elliptical splash fill having splash fill openings, said cooling tower fill support and grid assembly comprising a pair of fill hangers disposed in spaced-apart relationship with respect to each other, each of said fill hangers characterized by a first plurality of substantially parallel grid members and a second plurality of substantially parallel grid members intersecting said first plurality of substantially parallel grid members to define a plurality of grid openings for accommodating the elliptical splash fill, and an anchor rivet pin characterized by a pin base extending from each of said first plurality of substantially parallel grid members, said pin base having a flared tip for extending into said grid openings, respectively, and said anchor rivet pin each disproportionally spaced-apart from said second plurality of substantially parallel grid members, for extending through the splash fill openings and securing the elliptical splash fill in said fill hangers.

9. The cooling tower fill support and grid assembly of claim 8 comprising a generally L-shaped flange provided on at least a portion of each of said fill hangers and at least one opening provided in said flange for receiving a fastener and securing said flange to the cooling tower.

10. The cooling tower fill support and grid assembly of claim 9 comprising a plurality of notches provided in said flange for receiving the bottom ones of said second plurality of spaced-apart grid members in a pair of said fill hangers, wherein said fill hangers engaged in stacked relationship with respect to each other.

11. A method for securing elliptical splash fill members in cooling tower fill hangers having a grid characterized by a first plurality of grid members and a second plurality of grid members intersecting said first plurality of grid members to define a plurality of hanger grid openings, and an anchor rivet pin having a flared tip provided on each of said first plurality of grid members and extending into said plurality of hanger grid openings, respectively, said anchor rivet pin spaced-apart from said second plurality of grid members, said method comprising the steps of:

(a) inserting the elliptical splash fill members in said hanger grid openings, with the long axis of the elliptical splash fill members substantially perpendicular to said first plurality of grid members; and (b) rotating the elliptical splash fill members into engagement with said anchor rivet pin for securing the elliptical splash fill members in said cooling tower fill hangers.

12. The method according to claim 11 comprising the step of providing an L-shaped flange on each of said fill hangers and at least one opening in said L-shaped flange for receiving a fastener and securing said fill hanger to the cooling tower.

13. A cooling tower fill support and grid assembly comprising at least one pair of fill hangers, each of said fill hangers characterized by a first plurality of spaced-apart grid members and a second plurality of spaced-apart grid members intersecting said first plurality of spaced-apart grid members to define a plurality of grid openings and comprising fill slots in the fill and a pair of fill-engaging notches provided on said second plurality of spaced-apart grid members for receiving the fill slots and securing the fill in said grid openings.

* * * * *